US005556217A

United States Patent [19]

Deyo et al.

[11] Patent Number: 5,556,217

[45] Date of Patent: Sep. 17, 1996

[54] AUGER MOUNT

[75] Inventors: Charles Deyo; Verne C. Watts; Wally L. Kaczmarski, all of Lisbon, N. Dak.

[73] Assignee: Clark Equipment Company, Woodcliff Lake, N.J.

[21] Appl. No.: 273,504

[22] Filed: Jul. 11, 1994

[51] Int. Cl.[6] ..... F16C 11/00

[52] U.S. Cl. ..... 403/61; 403/59; 37/408; 243/652; 173/185

[58] Field of Search ..... 37/468, 403, 404, 37/405, 406, 407, 408, 409, 410, 466; 403/59, 61, 116, 79, 80, 82; 248/652, 664, 281.1; 173/24, 27, 28, 29, 43

[56] References Cited

U.S. PATENT DOCUMENTS

| | | | |
|---|---|---|---|
| 2,379,137 | 6/1945 | Feucht | 248/652 |
| 2,483,033 | 9/1949 | Baker | 37/408 |
| 2,844,006 | 7/1958 | Lutz et al. | 173/27 X |
| 3,193,999 | 7/1965 | Hester | 403/116 X |
| 3,430,703 | 3/1969 | Richey | 37/404 X |
| 3,705,632 | 12/1972 | Burke | 173/27 |
| 3,970,154 | 7/1976 | Bartels | 173/24 |
| 4,087,010 | 5/1978 | Stormon | 214/145 |
| 4,099,579 | 7/1978 | Stormon | 173/4 |
| 4,148,366 | 4/1979 | Beckstrom et al. | 173/28 |
| 4,150,504 | 4/1979 | Asche | 37/103 |
| 4,199,033 | 4/1980 | Van Gundy, Jr. | 173/27 |
| 4,417,628 | 11/1983 | Gessner | 173/29 |
| 4,641,716 | 2/1987 | Sjalander | 175/62 |
| 4,669,699 | 6/1987 | Kaneko | 248/652 |
| 4,772,150 | 9/1988 | Horton | 37/468 X |
| 4,854,814 | 8/1989 | Smith et al. | 414/723 |
| 4,889,192 | 12/1989 | Ricard | 173/22 |
| 4,890,680 | 1/1990 | Porsfeld | 173/42 |
| 4,998,590 | 3/1991 | Wells | 176/162 |
| 5,058,844 | 10/1991 | Webb | 403/61 X |
| 5,158,146 | 10/1992 | Fuller | 173/28 X |
| 5,171,124 | 12/1992 | Foster | 414/685 |
| 5,244,306 | 9/1993 | Artzberger | 37/403 X |
| 5,330,014 | 7/1994 | Wagner | 173/29 X |
| 5,375,349 | 12/1994 | Jochim | 37/409 X |

OTHER PUBLICATIONS

Earth Auger Attachments, "Pinpoint Accuracy. Powerful Hydraulics.", brochure.

*Primary Examiner*—Terry Lee Melius
*Assistant Examiner*—Victor Batson
*Attorney, Agent, or Firm*—Westman, Champlin & Kelly, P.A.

[57] ABSTRACT

The present invention relates to an auger mount device for coupling an auger to a vehicle such as an excavator, skid steer loader, or the like, having a dipper stick and a bucket link. The auger mount device comprises a mounting plate having a dipper end, an auger end, and a pivot aperture adjacent to the dipper end. The pivot aperture is suitable for mounting the auger mount device to the boom. A fin is attached to the mounting plate. The fin defines a slot suitable for attachment to the bucket link. The auger is mountable to the auger end.

16 Claims, 9 Drawing Sheets

AUGER MOUNT

BACKGROUND OF THE INVENTION

The present invention relates to an attachment for mounting an auger to a vehicle. Specifically, the present invention relates to an auger mount assembly for coupling an auger to an excavator, a backhoe attachment of a skid steer loader, or the like.

As is well known, an excavator is a vehicle used for digging holes in the earth or for moving earth. Excavators may be of various sizes and configurations, and are commonly driven by two endless belts. Excavators are typically equipped with operator controlled attachments such as a boom suitable for supporting a bucket or an auger.

Additionally, a skid steer loader is a relatively small four-wheel vehicle that has no steerable wheels. Turns are negotiated by locking the wheels on one side and driving the wheels on the other side or driving the wheels on one side in an opposite direction as those on the other side, the result being the ability to make a full turn on a minimum turning radius. A lift arm can be pivotally mounted to the vehicle to swing upwardly or downwardly and, when the arm swings downwardly, the forward end of the lift arm extends downwardly in front of the vehicle. Additionally, the skid steer loader can be equipped with a backhoe attachment coupled to the front of the vehicle.

As is also well known, an auger is a device for boring holes in the earth. An auger can be mounted either on the boom, lift arm, or backhoe attachment. The auger can be mounted to be free-swinging or be secured relative to the boom, lift arm, or backhoe attachment. A free-swinging auger is typically mounted to the boom or backhoe attachment by two pins oriented at 90° relative to one another. This gives the auger freedom of movement in two directions.

Often times, working on uneven terrain makes it difficult to position or control a free-swinging auger to drill specified holes. The free-swinging auger also poses a control problem during transport. For the foregoing reasons, there is a need for a device to enable the auger to find vertical yet permit operator control of the auger during transport or when drilling non-vertical holes.

SUMMARY OF THE INVENTION

The present invention relates to an auger mount device suitable for coupling an auger to a vehicle having an attachment, wherein the attachment includes a boom and a bucket link. The auger mount device comprises at least one mounting plate having a dipper end, an auger end, and a pivot aperture adjacent to the dipper end. The pivot aperture is suitable for pivotally mounting the auger mount device to the boom. A fin is attached to the mounting plate. The fin has a slot suitable for attachment to the bucket link. The auger is mountable to the auger end of the auger mount device.

The vehicle operator has the ability to control the auger using the bucket cylinder and the bucket link when the bucket link is at the ends of the slot. Also, the present auger mount device allows the auger to find vertical when the bucket link is not at the ends of the slot.

DETAILED DESCRIPTION OF THE PREFERRED EMBODIMENTS

Figure 1A:
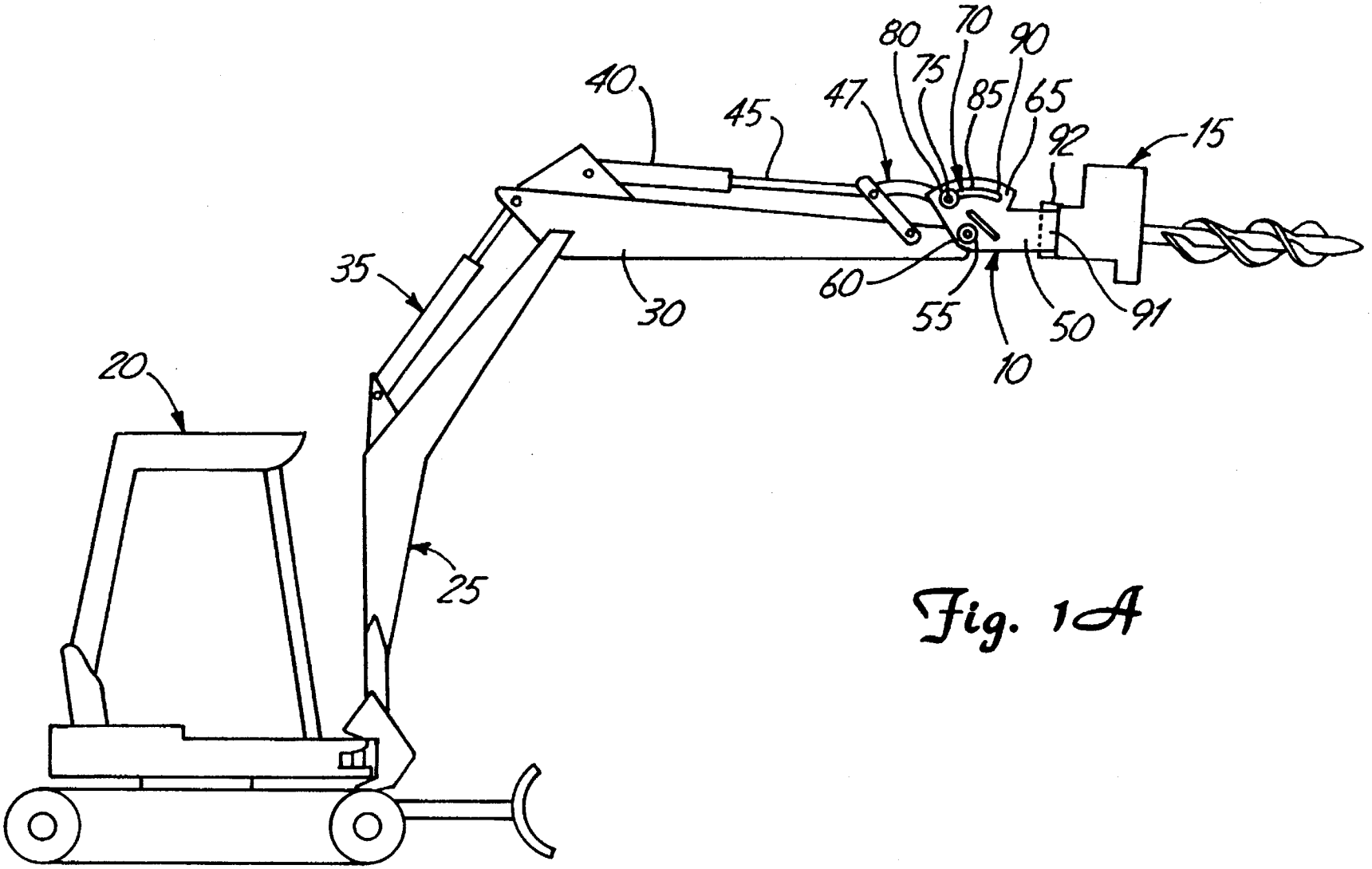
FIG. 1A is a side view of a typical excavator equipped with a boom, an auger and the auger mount device of the present invention.

In FIG. 1A, an auger mount 10 of the present invention is shown attached to an auger 15 and controlled by an excavator 20 through a boom 25. The boom typically comprises a dipper stick 30 pivotally attached to the boom 25 and controlled by a first hydraulic cylinder 35. A bucket cylinder 40 having a piston 45 is attached to the dipper stick 30. The piston 45 is attached to a bucket link 47 and can be manipulated by the operator actuating bucket cylinder 40.

The auger mount 10 comprises at least one generally flat mounting plate 50 having a pivot aperture 55 suitable for accepting a dipper pin 60 for pivotally attaching the auger mount 10 to the dipper stick 30. A generally flat fin 65 having a slot 70 is attached to the mounting plate 50. The bucket link 47 is slidably attached to the fin 65 within the slot 70 by means of a link pin 75. The slot 70 has a proximal end 80, intermediate portion 85, and a distal end 90 within slot 70. The bucket link 47, and link pin 75 can freely slide between the proximal end 80 and the distal end 90. The auger 15 is attached to the auger mount 10 by an auger pin 92 extending through a sleeve 91 (shown in phantom).

FIG. 1A shows the auger 15 in a substantially horizontal orientation. This is accomplished by actuating the bucket cylinder 40 to retract the piston 45 causing the bucket link 47 to pivot and urge the link pin 75 against the proximal end 80 of the slot 70. Thus, the link pin 75 pulls the auger mount 10 toward the bucket cylinder 40 causing the auger mount 10 to pivot about the dipper pin 60.

Figure 1B:
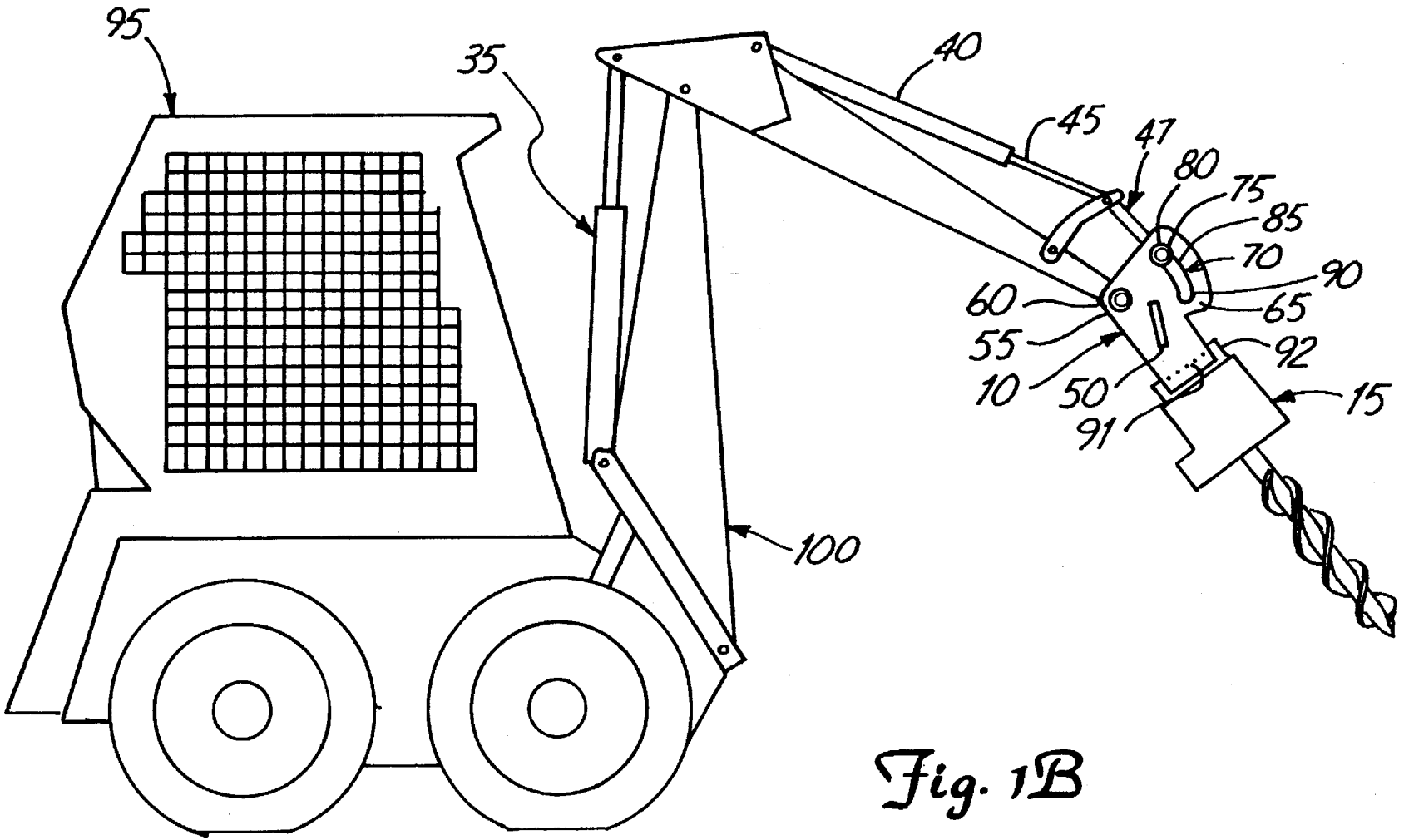
FIG. 1B is a side view of a typical skid steer loader equipped with a backhoe attachment, an auger and the auger mount device of FIG. 1A.

FIG. 1B shows the auger mount 10 of FIG. 1A as used on a skid steer loader 95 having a backhoe attachment 100 much like the boom 25 of FIG. 1A. Again, the auger mount 10 is pivotally attached to the dipper stick 30, and the bucket link 47 is slidably attached to the slot 70 and secured by link pin 75. Also, the auger 15 is attached to the sleeve 91 of auger mount 10 by means of the auger pin 92.

Figure 2B:
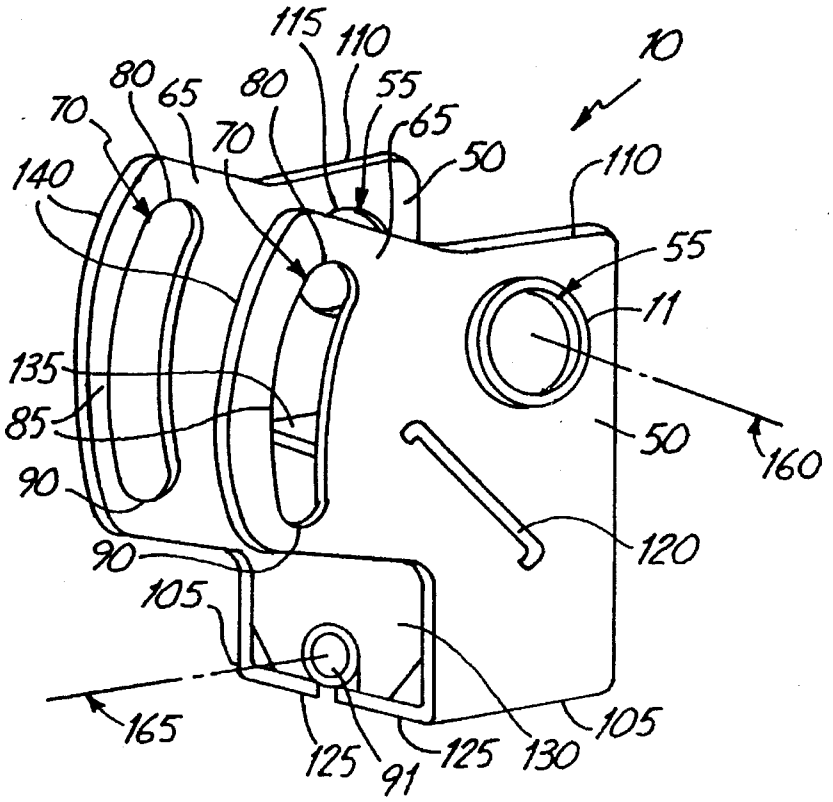
FIG. 2B is a perspective view of the auger mount device of FIGS. 1A and 1B, and transverse view of FIG. 2A.
Figure 2A:
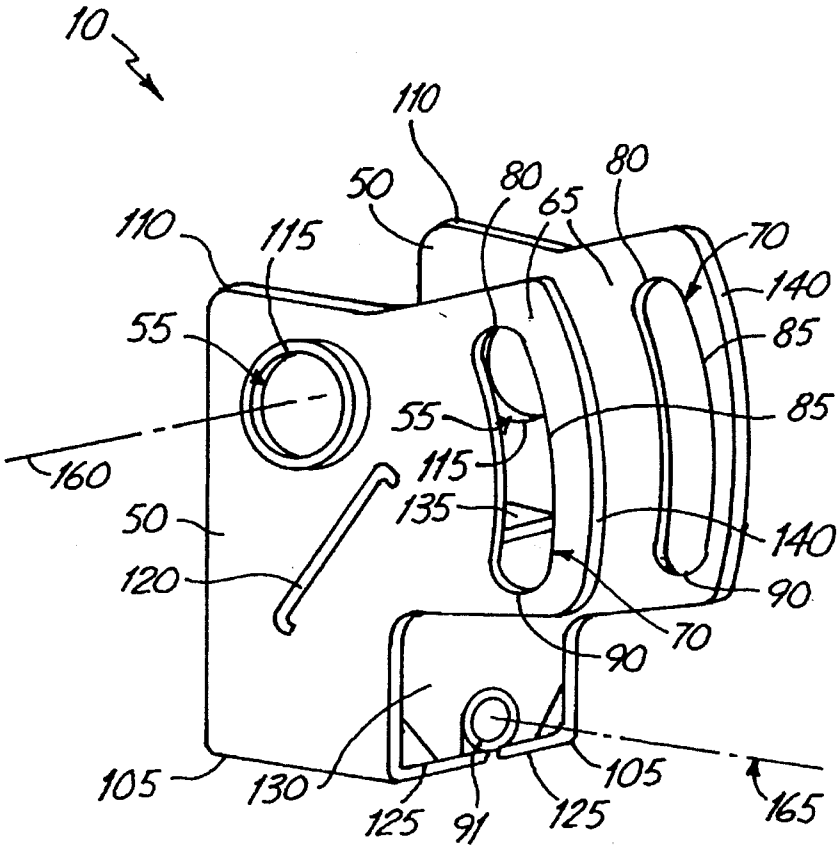
FIG. 2A is a perspective view of the auger mount device of FIGS. 1A and 1B.

FIGS. 2A and 2B show that the auger mount 10 preferably includes two mounting plates 50 having auger ends 105 and dipper ends 110. The mounting plates 50 are preferably mounted generally parallel and transverse to each other. The pivot apertures 55 are adjacent to the dipper ends 110 of the mounting plates 50 and are axially aligned along axis 160. Within the pivot apertures 55 are pivot bushings 115 for reducing friction between the auger mount 10 and the dipper pin 60. Handles 120 are preferably attached to the mounting plates 50 adjacent the pivot apertures 55. The handles 120 can aid the operator in lifting and coupling the auger mount 10 to the boom 25. Also, the handles 120 can be used to guide and direct hoses or conduits 122 therethrough so as to minimize the risk of the hoses or conduits 122 becoming pinched by the boom 25 or the auger 15 during operation.

Two substantially flat auger plates 125 are attached to the auger ends 105 of the mounting plates 50. Preferably one auger plate 125 is attached to each mounting plate 50. The mounting plate 50 and auger plate 125 are typically integrally fabricated with one another by bending elongated mounting plate 50. The mounting plates 50 are secured together by means of braces 130 and 135 affixed to the mounting plates 50 and auger plates 125. The braces 130 and 135 are oriented so as to be generally perpendicular to the mounting plates 50 and upstanding on the auger plates 125 as shown in greater detail in FIGS. 3A and 3B and discussed below. The sleeve 91 is affixed to the auger plates 125 and is preferably of cylindrical shape suitable for accepting the auger pin 92.

A fin 65 is attached to each mounting plate 50. The fins 65 are preferably rigidly affixed to, or an integral part of, the mounting plates 50. The fins 65 preferably have an arcuate edge 140, with the interior of each fin defining slot 70 which is suitable for accepting the link pin 75.

Figure 3B:
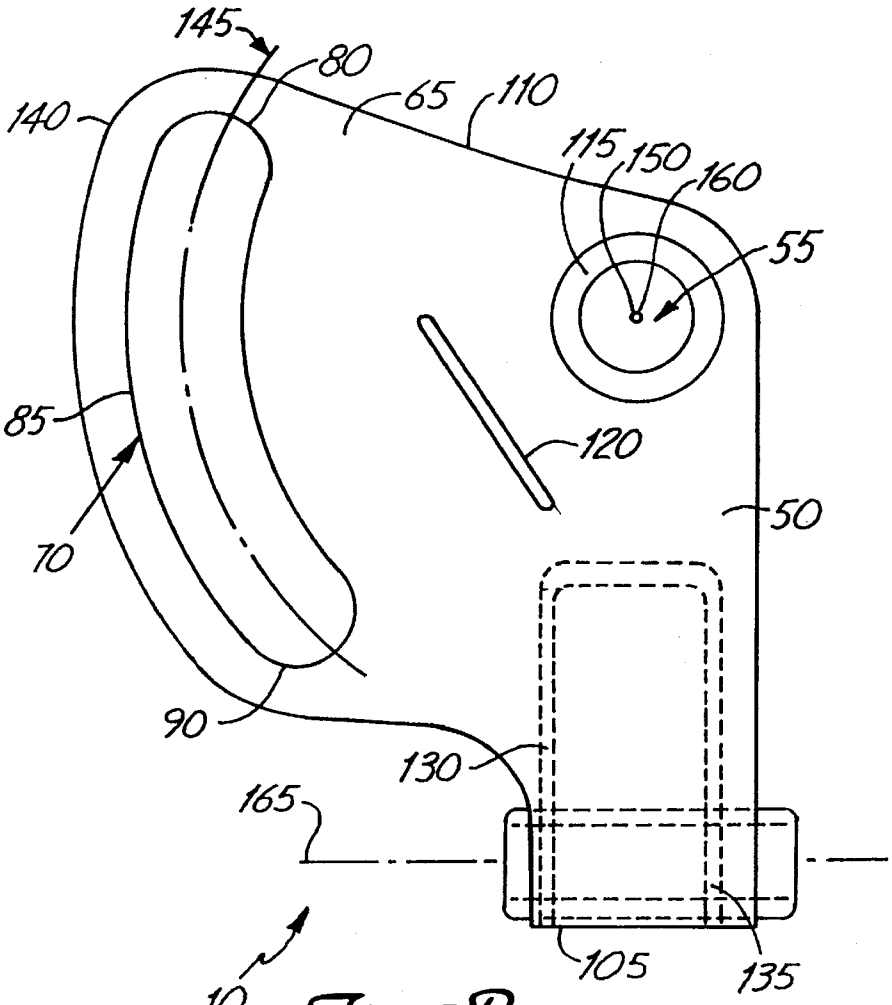
FIG. 3B is a side elevational view of the auger mount device of FIGS. 1A and 1B, and a transverse view of FIG. 3A.
Figure 3A:
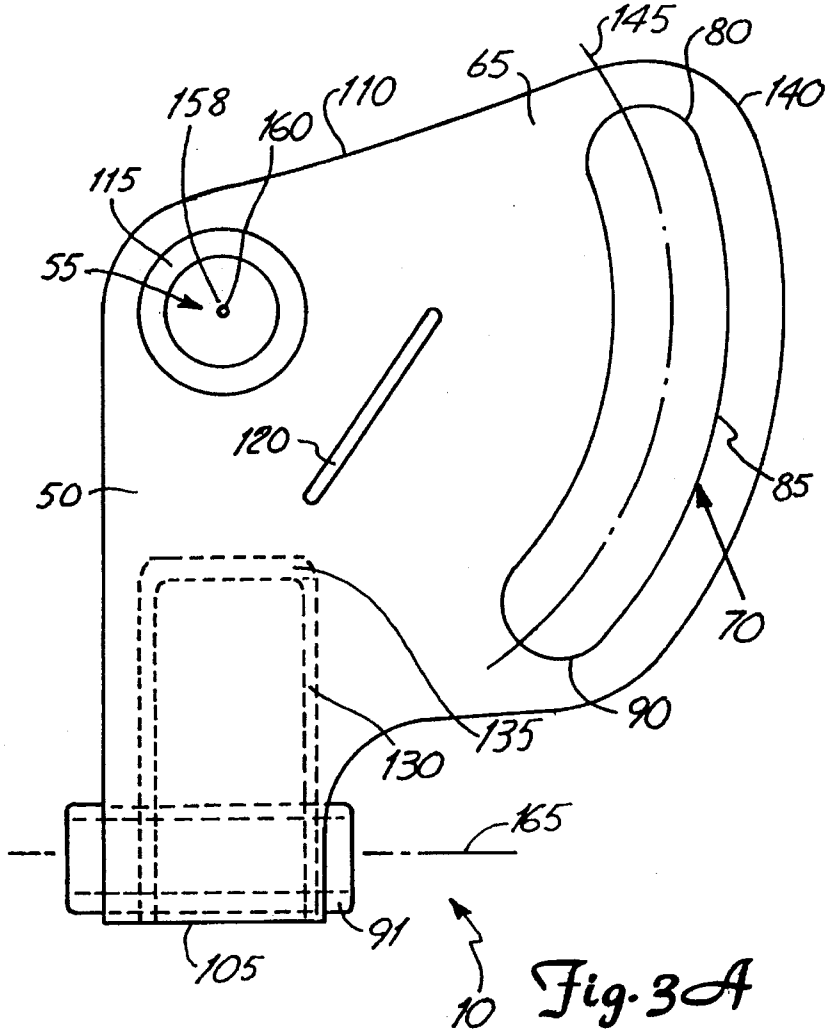
FIG. 3A is a side elevational view of the auger mount device of FIGS. 1A and 1B.
Figure 3C:
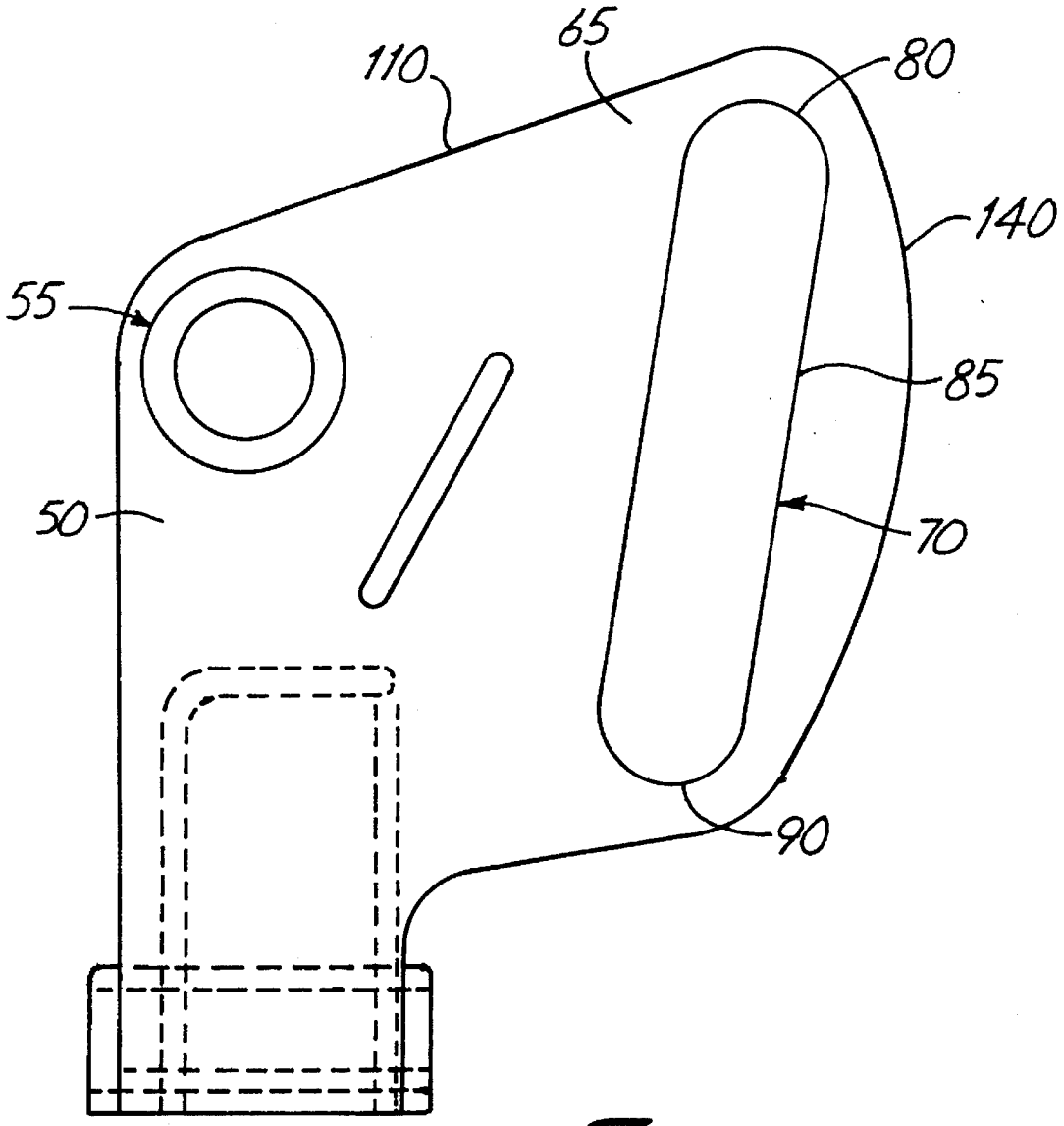
FIG. 3C is a side elevational view of another embodiment of the present invention.

FIGS. 3A and 3B show that the slots 70 preferably trace an arc 145 of a circle having a center 150 coaxial with dipper pivot axis 160 so that the auger mount 10 pivots about dipper pivot axis 160. As shown in FIG. 3C, however, the slots 70, need not be an arc, but can be linear or any other suitable configuration. Referring again to FIGS. 3A and 3B, the braces 130 and 135, shown in phantom, are oriented so as to be perpendicular to the mounting plates 50. Also, the sleeve 91 preferably extends past the sides of the mounting plates 50. The auger 15 is allowed to pivot about an auger pivot axis 165 defined by sleeve 91, preferably ten degrees each side of vertical to prevent damage of the auger mount 10 while in use.

The mounting plates 50 together with the fins 65 define a generally "L" shape for auger mount 10. The auger mount 10 could have a wide variety of other configurations, but the configuration shown in the Figures is convenient because it allows proper balancing of the auger 15 when the auger 15 is finding vertical during operation.

Figure 4A:
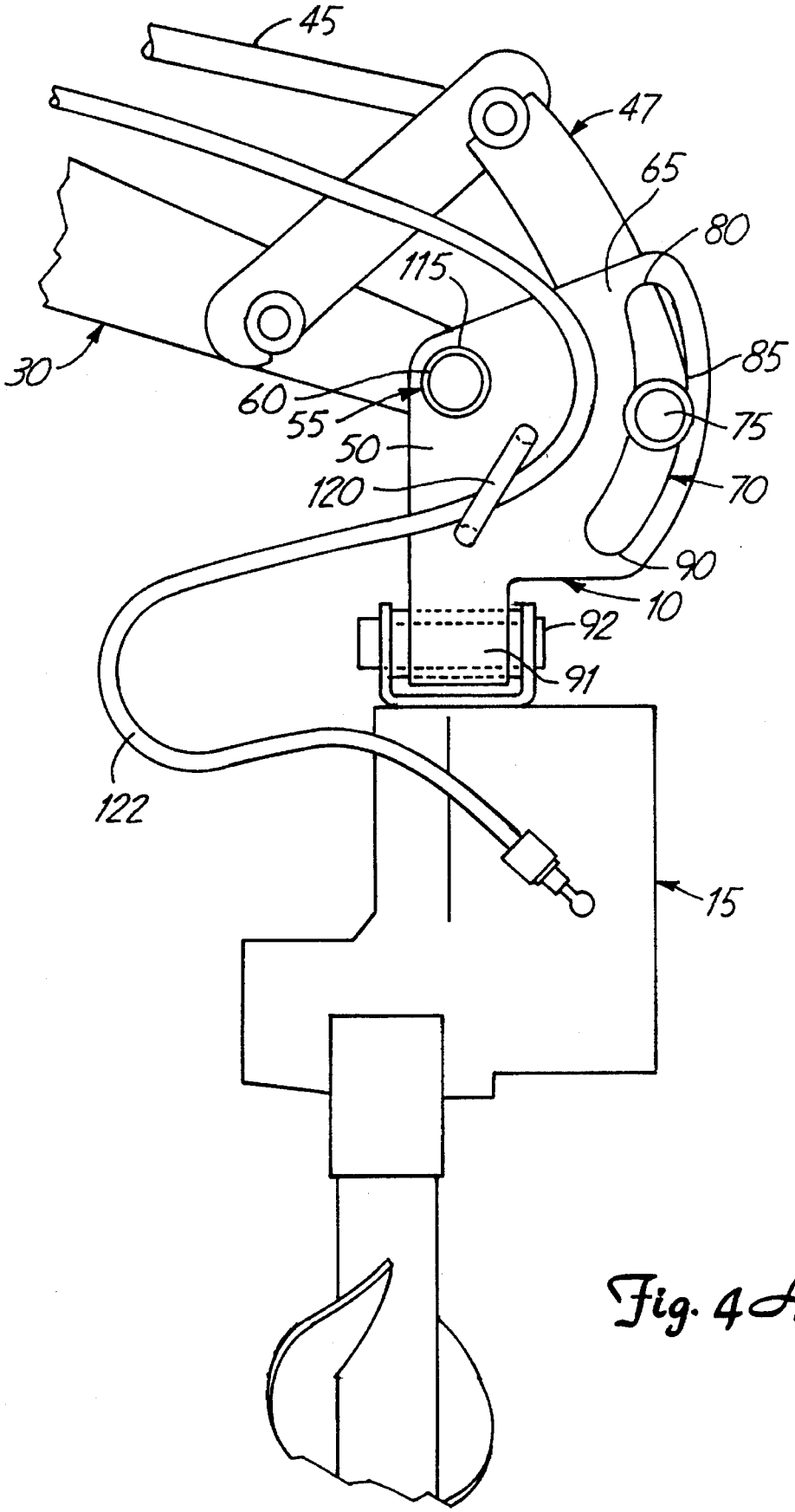
FIG. 4A is a side view of the auger mount device of FIGS. 1A and 1B in operation with the auger in a vertical orientation.
Figure 4B:
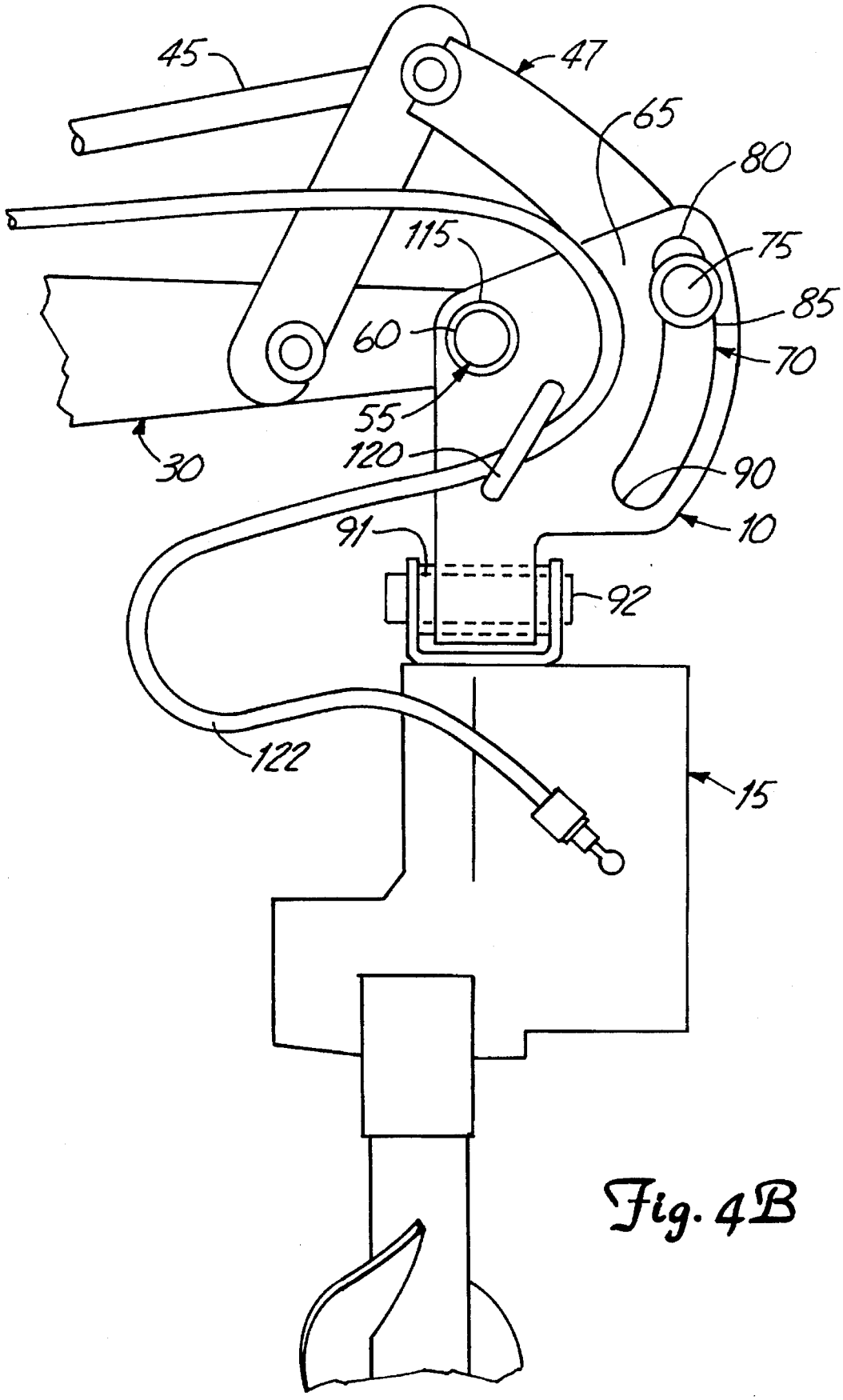
FIG. 4B is a second side view of the auger mount device of FIGS. 1A and 1B in operation with the auger in its vertical orientation.

FIGS. 4A, 4B, 5A, and 5B illustrate the auger mount 10 in use and in various orientations. FIGS. 4A and 4B show the auger mount 10 allowing the auger 15 to find vertical when the link pin 75 is at the intermediate portion 85 of the slot 70 regardless of the orientation of the dipper stick 30. The operator may retract or extend the piston 45 so the bucket link 47 places the link pin 75 at the intermediate portion 85 of the slot 70. Because the link pin 75 does not engage auger mount 10 or impose a constraint on the auger mount 10, the auger 15 can find vertical by freely hanging from the dipper pin 60.

The dipper stick 30 of FIG. 4B is in a different orientation with respect to vertical than the dipper stick 30 of FIG. 4A. Yet, because the link pin 75 is at the intermediate portion 85 of the slot 70 where the link pin 75 does not engage the auger mount 10, the auger 15 is allowed to find vertical. Therefore, merely by adjusting the bucket link 47 using the bucket cylinder 40 so the link pin 75 is in the intermediate portion 85 of the slot 70, the operator is able to verify that the auger 15 is vertical.

Figure 5A:
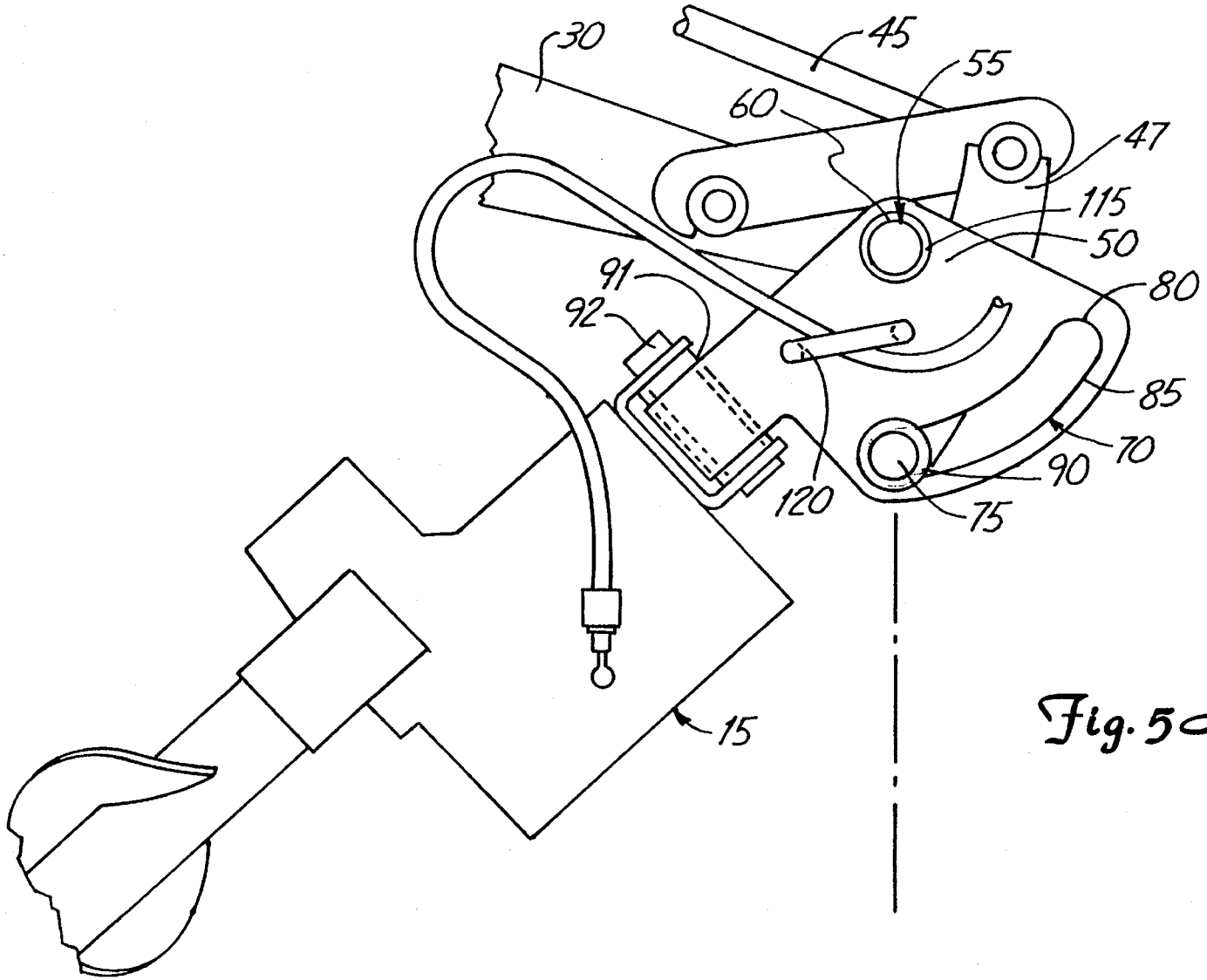
FIG. 5A is a side view of the auger mount device of FIGS. 1A and 1B in operation where the auger is not in a vertical orientation.

FIG. 5A, however, shows the result when the operator has extended the piston 45 so that the bucket link 47 pivots to urge the link pin 75 against the distal end 90 of the slot 70. By continuing to extend piston 45, the operator can easily control auger 15 to pivot inwardly about the dipper pivot axis 160 toward the vehicle 20 or 95.

Figure 5B:
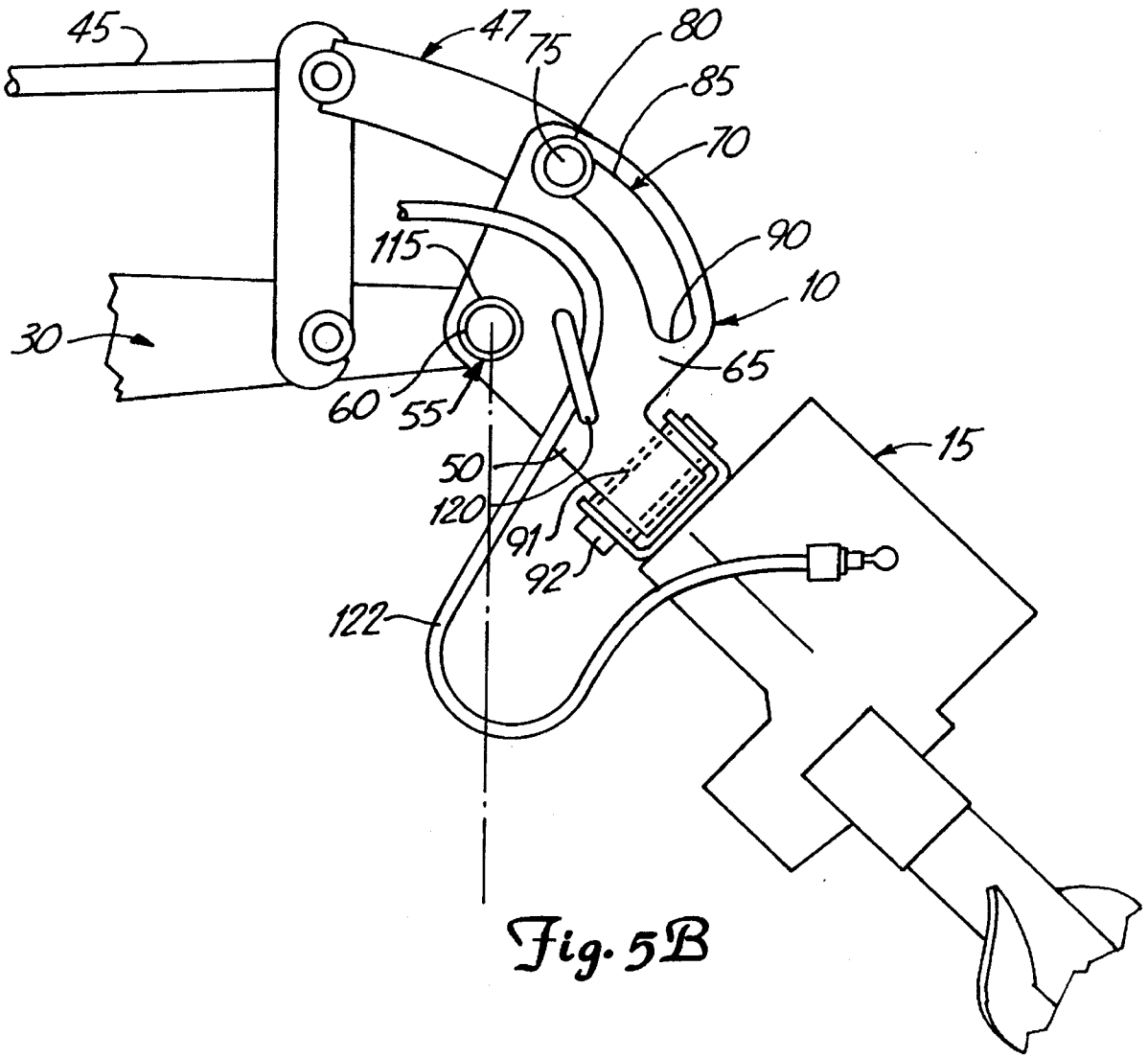
FIG. 5B is a second side view of the device of FIGS. 1A and 1B in operation where the auger is not in a vertical orientation.

FIG. 5B shows the piston 45 retracted into the bucket cylinder 40. The bucket link 47 has urged the link pin 75 against the proximal end 80 of the slot 70. By continuing to retract piston 45, the operator can control the auger 15 to pivot outwardly about the dipper pivot axis 160 away from the vehicle by "pulling" the auger mount 10. This auger position is also shown in FIGS. 1A and 1B.

Thus, the operator can position the auger 15 by using the bucket cylinder 40 and bucket link 47 to exert a force against either the distal or proximal ends 80 or 90 of the slot 70. It is preferred that the bucket link 47 is engaged with one of the ends 80 or 90 of the slot 70 during transport. This provides improved control of the auger during transportation. Also, the auger 15 is free to pivot about the dipper pivot axis 160 and hang in a vertical orientation, regardless of the position of the boom 25 or dipper stick 30, as long as the link pin 75 is in the intermediate portion 85 of the slot 70.

Although the present invention has been described with reference to preferred embodiments, workers skilled in the art will recognize that changes may be made in form and detail without departing from the spirit and scope of the invention.

What is claimed is:

1. A mounting device for mounting an auger on a vehicle, the vehicle having an attachment including a boom and at least one link, the mounting device comprising:

a first mounting plate and a second mounting plate, the first and second mounting plates being disposed generally parallel to one another, each mounting plate having a dipper end, an auger end, and a pivot aperture suitable for pivotal attachment to the boom, the first and second mounting plates each having a fin portion defining a slot suitable for receiving the link wherein each slot includes two closed ends and an intermediate portion therebetween, each of the fin portions being attached to one of the mounting plates adjacent the dipper end; and means for attaching the auger to the mounting device;

wherein the first and second mounting plates are coupled to one another so the first and second pivot apertures are aligned to receive a pivot pin to pivotably connect the mounting device to the boom, and wherein the first and second slots are aligned to receive a link pin attached to the link and to hold the link pin slidably within the slots so the device is freely pivotable relative to the boom as the link pin slides within the slots when the link pin is at the intermediate portion and is controllably pivotable by the link, relative to the boom, when the link pin is at either one of the two ends.

2. The mounting device of claim 1 and further comprising:

means for attaching the first mounting plate to the second mounting plate including at least one brace member attached to, and spacing apart, the first and second mounting plates such that the first mounting plate is generally transverse to the second mounting plate, the brace member generally perpendicular to the mounting plates.

3. The mounting device of claim 2 and further comprising:

a second brace member attaching the first mounting plate to the second mounting plate, the second brace member being generally perpendicular to the first and second mounting plates.

4. The mounting device of claim 2 wherein the slots trace an arc of a circle having a center generally coaxial with the pivot apertures.

5. The mounting device of claim 4 and further comprising:

a first auger plate attached to the auger end of the first mounting plate, the first auger plate being generally perpendicular to the first mounting plate; and a second auger plate attached to the auger end of the second mounting plate, the second auger plate being generally perpendicular to the second mounting plate.

6. The mounting ,device of claim 4 wherein the means for attaching the auger to the mounting device comprises means for pivotably attaching the auger to the mounting device.

7. The mounting device of claim 6 wherein the means for pivotably attaching the auger to the mounting device comprises an auger pivot sleeve attached to the mounting device.

8. The mounting device of claim 1 and further comprising:

a first bushing attached to the first mounting plate within the first pivot aperture; and a second bushing attached to the second mounting plate within the second pivot aperture.

9. The mounting device of claim 1 and further comprising:

a first guide handle attached to the first mounting plate; and a second guide handle attached to the second mounting plate.

10. The mounting device of claim 1 wherein the slot is generally linear.

11. An auger mount for attaching an auger to a vehicle, the vehicle having a boom and at least one link, the auger mount comprising:

a first mounting plate having an auger end, a dipper end, and a pivot aperture adjacent to the dipper end, the pivot aperture suitable for pivotal attachment to the boom;

at least one fin portion defining a slot suitable for slidable attachment to the link, the slot having an intermediate portion and two closed ends wherein the auger mount is freely pivotable about the pivot aperture when the link is at the intermediate portion and is controllably pivotable by the link, relative to the boom, when the link pin is at either one of the two ends, the fin portion attached to the mounting plate adjacent the dipper end; and means for attaching the auger to the auger mount.

12. The auger mount of claim 11 and further comprising a second mounting plate having an auger end, a dipper end, a pivot point adjacent to the dipper end, the second mounting plate attached to and generally opposing the first mounting plate.

13. The auger mount of claim 12 and further comprising:

a first auger plate attached to the first mounting plate; and a second auger plate attached to the second mounting plate.

14. The auger mount of claim 11 wherein the means for attaching the auger to the auger mount comprises an auger pivot sleeve attached to the auger mount.

15. The auger mount of claim 11 and further comprising a pivot bushing affixed to the pivot aperture.

16. The auger mount of claim 11 wherein the slot traces an arc of a circle having a center generally coaxial with the pivot aperture.

* * * * *